US006651918B2

(12) United States Patent
Huang

(10) Patent No.: US 6,651,918 B2
(45) Date of Patent: Nov. 25, 2003

(54) PLASTIC FILM DISPENSING APPARATUS CAPABLE OF ADJUSTING TENSION OF THE FILM

(76) Inventor: Harrison Huang, No. 23, Lin T'So Rd., Sheng Kang Hsian, Taichung Hsien (TW)

( * ) Notice: Subject to any disclaimer, the term of this patent is extended or adjusted under 35 U.S.C. 154(b) by 73 days.

(21) Appl. No.: 10/117,105

(22) Filed: Apr. 8, 2002

(65) Prior Publication Data

US 2003/0132336 A1 Jul. 17, 2003

(30) Foreign Application Priority Data

Jan. 17, 2002 (TW) ..... 91200353 U

(51) Int. Cl.[7] ..... B65H 23/06
(52) U.S. Cl. ..... 242/423.1; 242/588.2
(58) Field of Search ..... 242/588.2, 423.1, 242/423.2

(56) References Cited

U.S. PATENT DOCUMENTS 4,535,951 A * 8/1985 Riemenschneider, III ..... 242/423.2
6,019,308 A 2/2000 Huang
6,027,069 A 2/2000 Huang
6,227,480 B1 5/2001 Huang

* cited by examiner

*Primary Examiner*—John Q. Nguyen
(74) *Attorney, Agent, or Firm*—Browdy and Neimark, P.L.L.C.

(57) ABSTRACT

A plastic film dispensing apparatus is constructed to includes a holder base, the holder base having a hollow body with a bottom opening and a top center through hole, a rotary member having a hollow cylindrical body sleeved onto the holder base and a circular top center coupling hole disposed in vertical alignment with the top center through hole of the holder base, an adjustment member pivoted to the holder base, and a rod member coupled to the adjustment member for axial movement relative to the holder base upon rotary motion of the adjustment member to stop the rotary member from rotary motion relative to the holder base or to let the rotary member be rotated with the roll of plastic film carried thereon relative to the holder base.

9 Claims, 8 Drawing Sheets

PLASTIC FILM DISPENSING APPARATUS CAPABLE OF ADJUSTING TENSION OF THE FILM

FIELD OF THE INVENTION

The present invention relates to a dispensing apparatus and, more particularly to a plastic film dispensing apparatus which is capable of adjusting the tension of the plastic film.

BACKGROUND OF THE INVENTION

A roll of plastic film, for example, a plastic wrap may be used with a pair of dispensing apparatus, which are inserted into tow ends of the roll respectively, for easy application to the object to be packed. Exemplars of dispensing apparatus are seen in U.S. Pat. Nos. 6,027,069; 6,019,308; 6,227,480. A regular dispensing apparatus for this purpose is comprised of two elements. The first dispenser element (of cylindrical shape) is inserted into one end of the roll of plastic film and pivotally supported on the second dispenser element. During application, the roll of plastic film is rotated with the first dispenser element on the second dispenser element. This design of dispensing apparatus has no means to stop the first dispenser element from rotary motion relative to the second dispensing element. When stopping the roll of plastic film and the first dispenser element from rotary motion relative to the second dispenser element, the user shall have to hold the dispenser elements with both hands, keeping the thumb pressed on the roll of plastic film. This operation action is inconvenient, and requires much effort.

SUMMARY OF THE INVENTION

The primary objective of the present invention is to provide a roll of plastic film dispensing apparatus, which is capable of adjusting tension of the plastic film conveniently, i.e. the film can be adjusted by the dispensing apparatus between a first mode to stop the loaded roll of plastic film from rotary motion, and a second mode to let the loaded roll of plastic film be freely rotated applied to the object to be packed.

To achieve this objective of the present invention, the plastic film dispensing apparatus comprises a holder base, a rotary member, an adjustment member and a rod member. The holder base has a bottom opening and a top center through hole in two ends of a hollow body thereof. The rotary member is supported on the holder base, said rotary member comprising a hollow cylindrical body defining a bottom opening and sleeved onto the hollow body of said holder base, a top center coupling hole disposed in vertical alignment with the top center through hole of said holder base, and a positioning flange supported on said holder base. The adjustment member is pivoted to the hollow body of said holder base, said adjustment member comprising a screw hole disposed in axial alignment with the top center through hole of said holder base. That rod member is provided with a insertion section inserted through the top center through hole of said holder base and the top center coupling hole of said rotary member, a threaded section disposed at an end thereof and threaded into the screw hole of said adjustment member, and a press portion disposed at an opposite end thereof for axial movement with said rod member relative to said rotary member upon rotary motion of said adjustment member and being capable of contacting said rotary member.

DETAILED DESCRIPTION OF THE INVENTION

Figure 1:
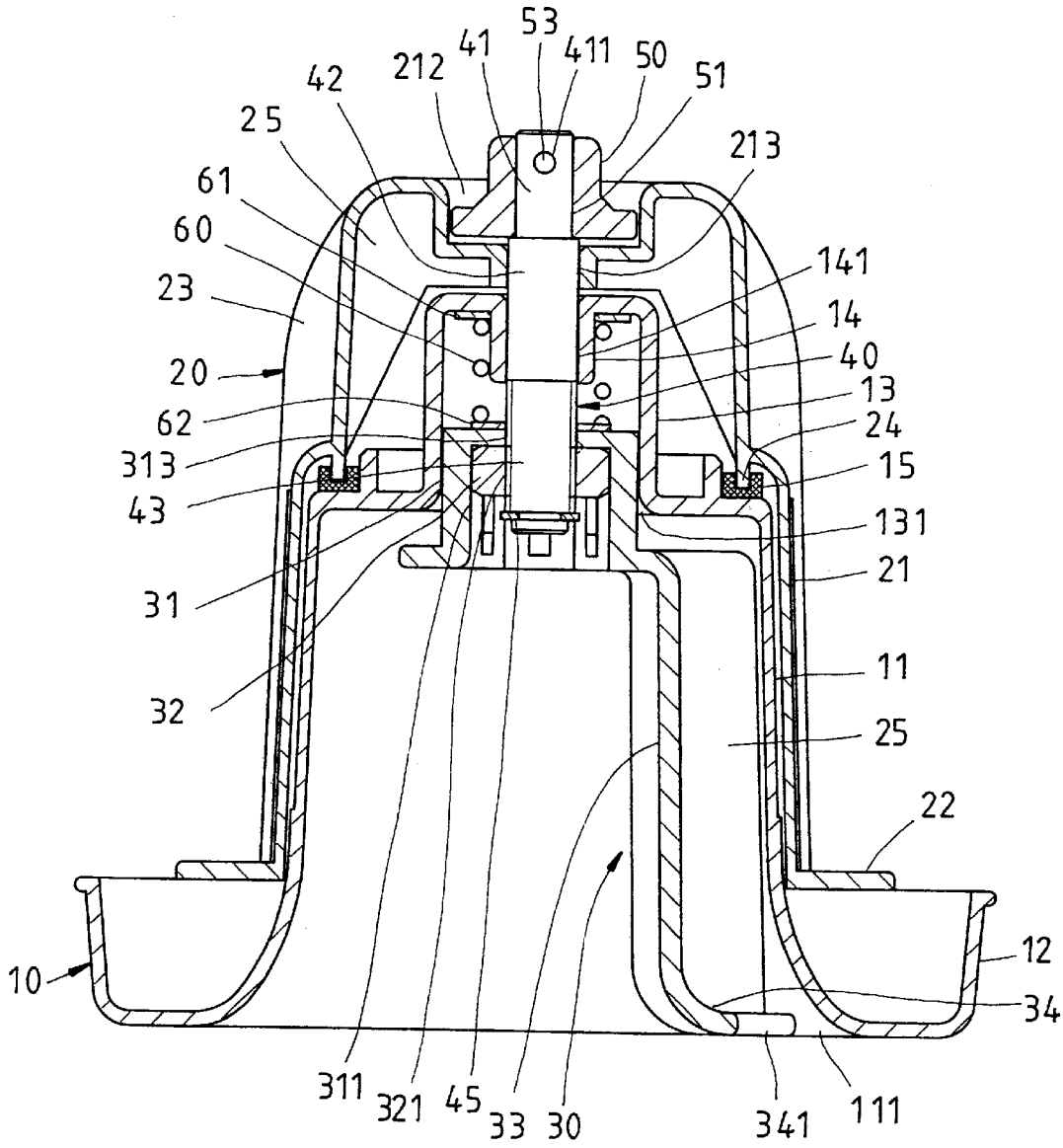
FIG. 1 is a sectional side view of a preferred embodiment according to the present invention.
Figure 2:
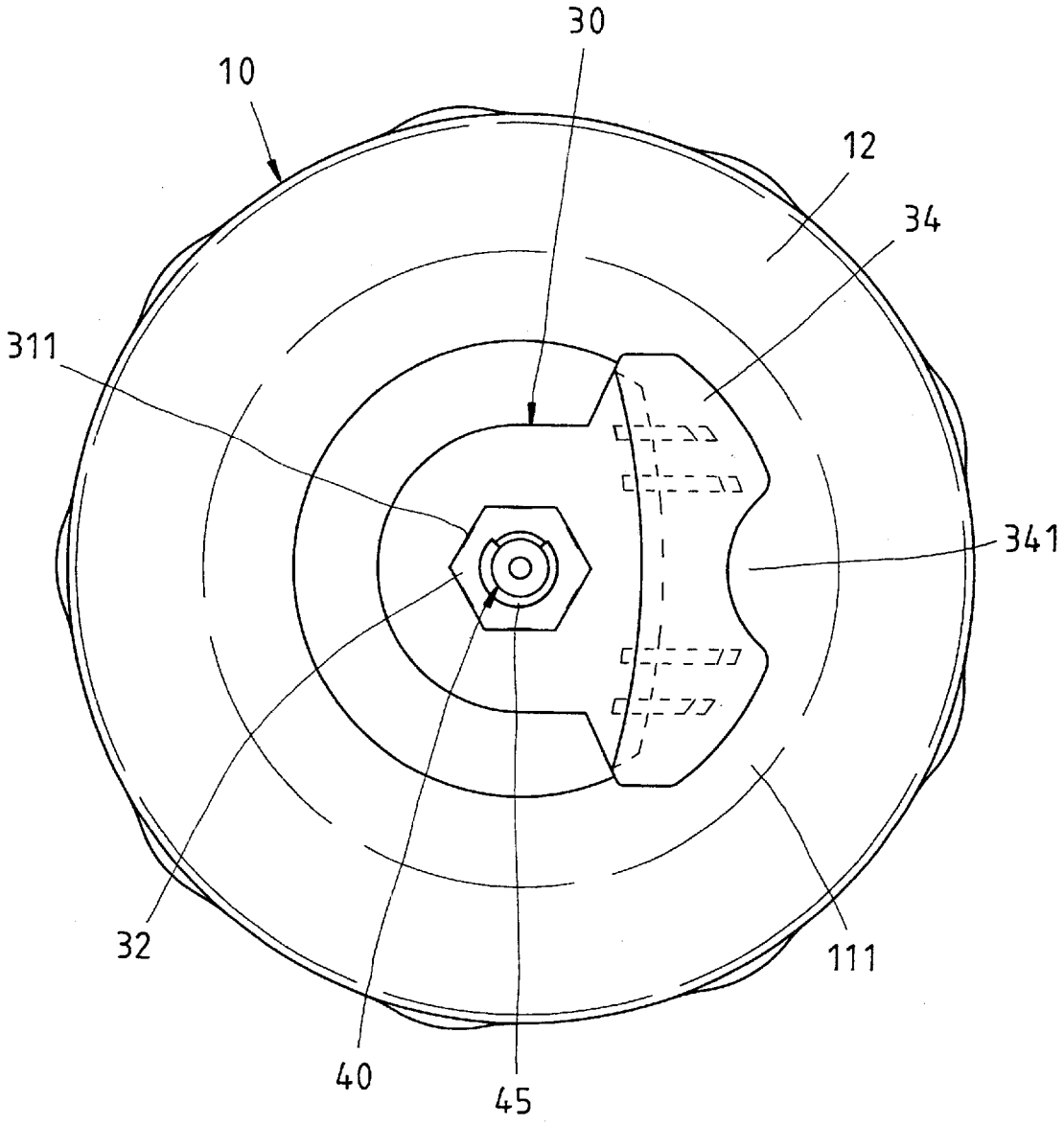
FIG. 2 is a bottom view of the preferred embodiment of the present invention.

Referring to FIGS. 1 and 2, a roll of plastic film dispensing apparatus in accordance with the present invention is generally comprised of a holder base 10, a rotary member 20 coupled to the holder base 10, an adjustment member 30 pivoted to the holder base 10, a rod member 40 inserted through the adjustment member 30, the holder base 10 and the rotary member 20, and a spring member 60 supported between the holder base 10 and the adjustment member 30.

Figure 3:
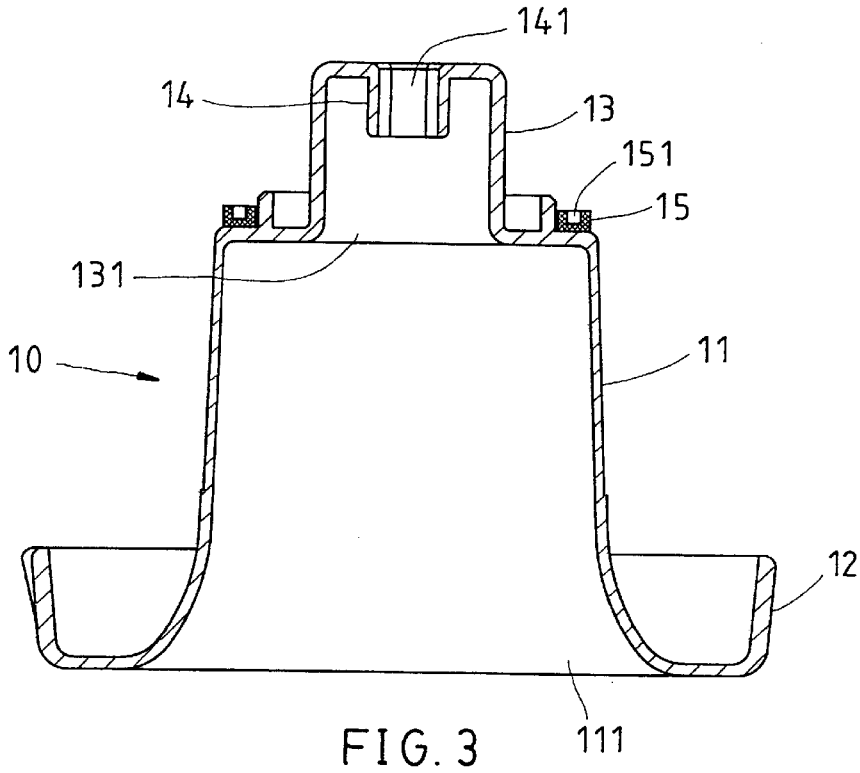
FIG. 3 is a sectional view of the holder base for the preferred embodiment of the present invention.
Figure 4:
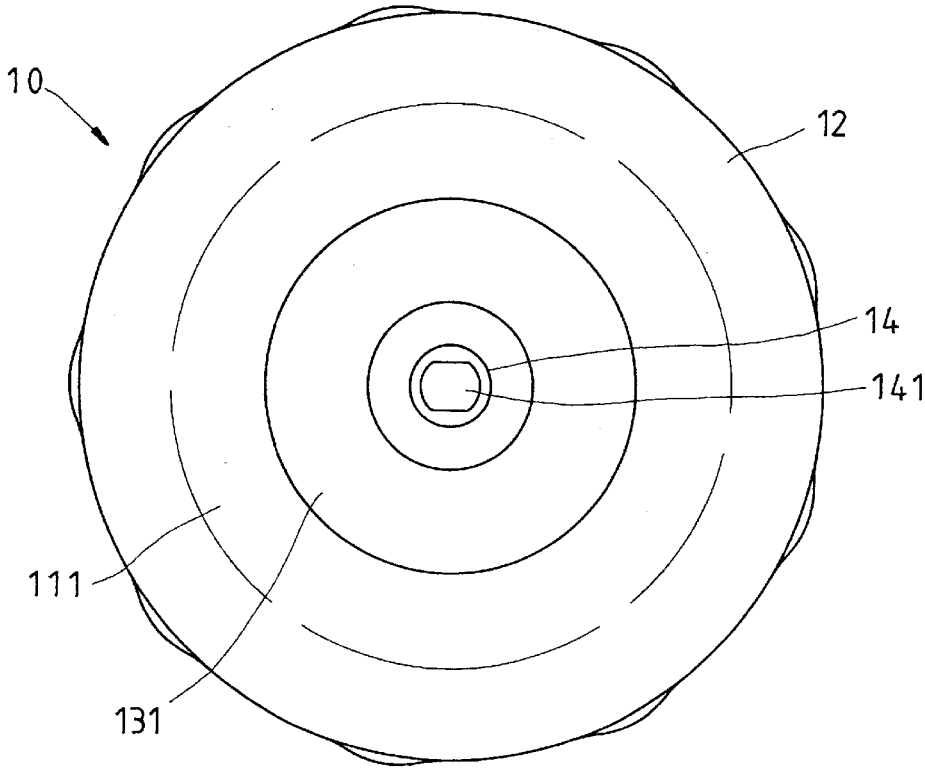
FIG. 4 is a bottom view of the holder base for the preferred embodiment of the present invention.
Figure 5:
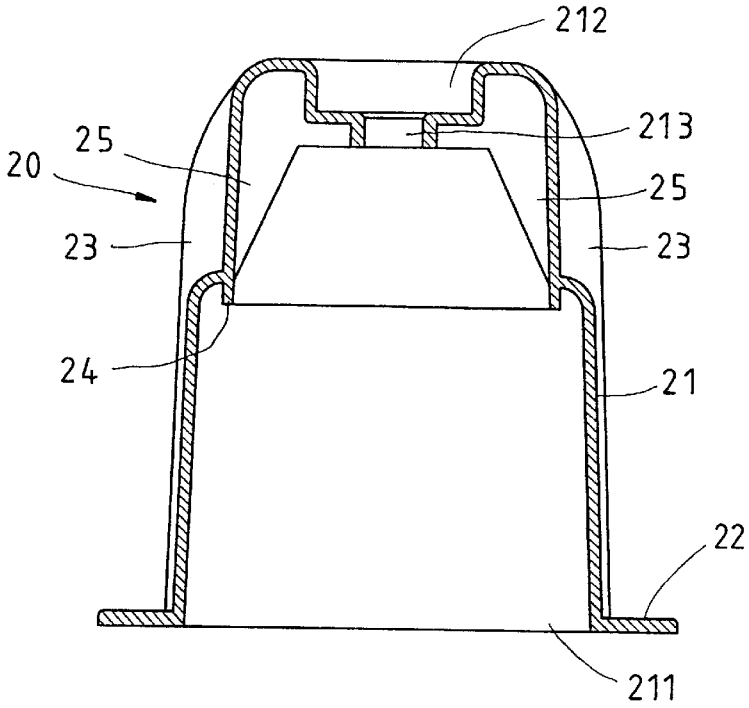
FIG. 5 is a sectional view of the rotary member for the preferred embodiment of the present invention.
Figure 6:
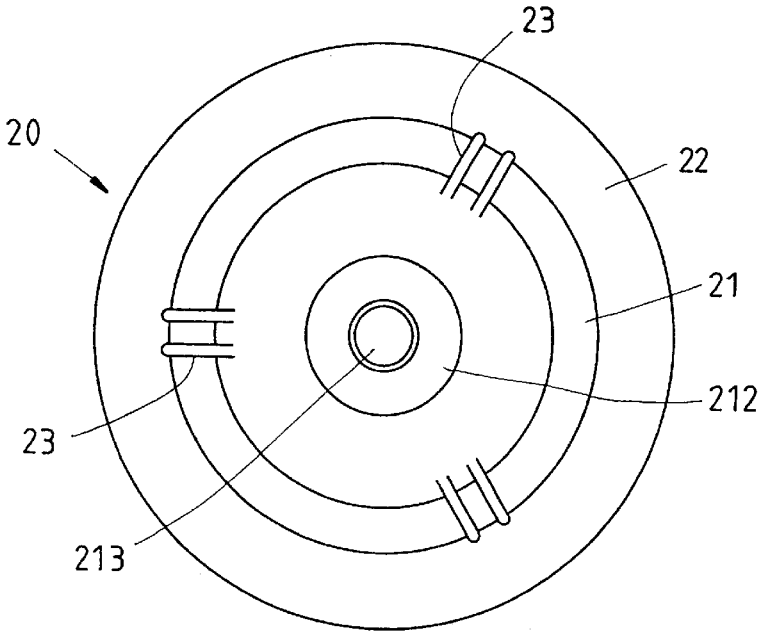
FIG. 6 is a top view of the rotary member for the preferred embodiment of the present invention.
Figure 7:
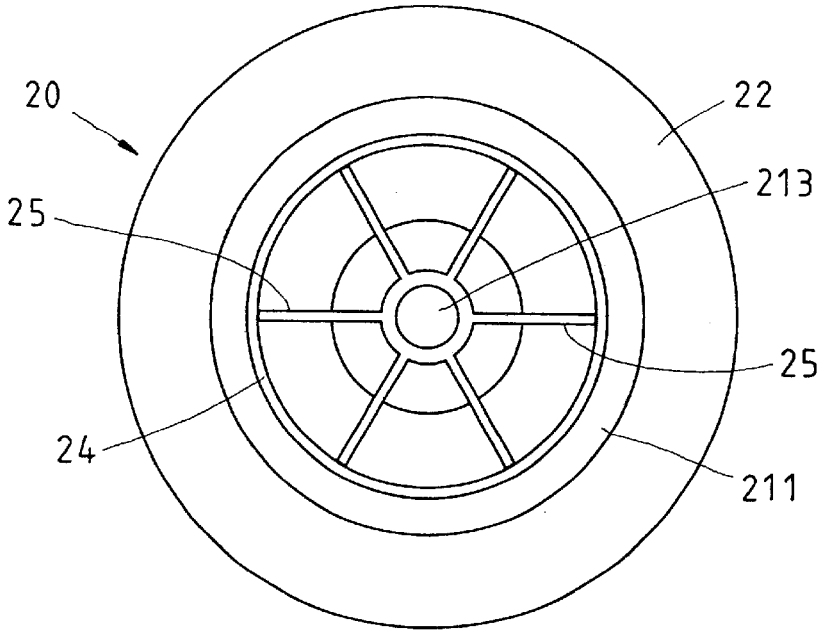
FIG. 7 is a bottom view of the rotary member for the preferred embodiment of the present invention.
Figure 8:
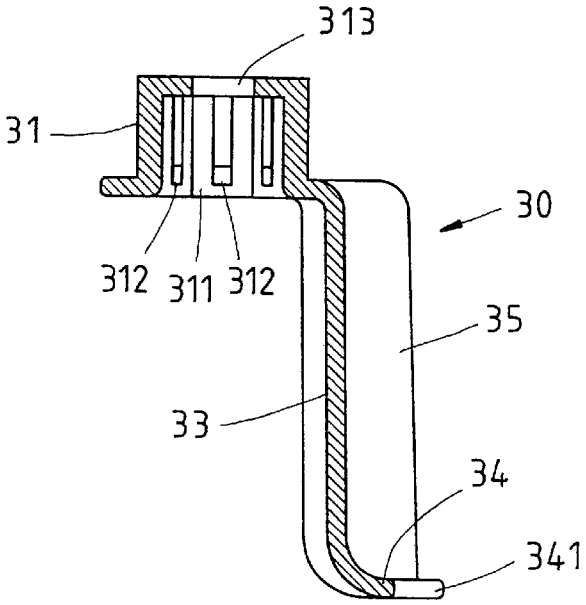
FIG. 8 is a sectional view of the adjustment member for the preferred embodiment of the present invention.
Figure 9:
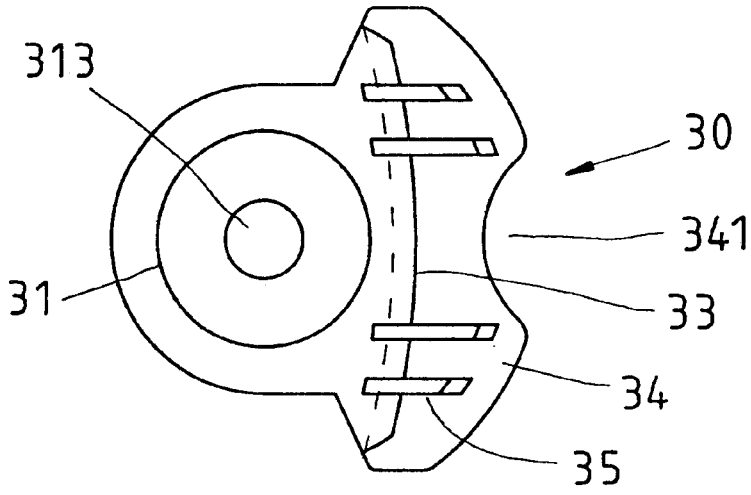
FIG. 9 is a top view of the adjustment member for the preferred embodiment of the present invention.
Figure 10:
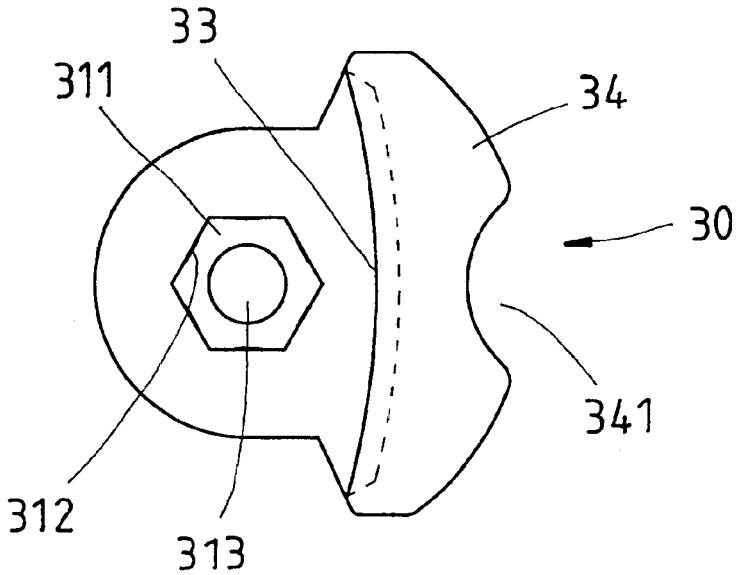
FIG. 10 is a bottom view of the adjustment member for the preferred embodiment of the present invention.

Referring to FIGS. 3 and 4, the holder base 10 is injection-molded from plastics, comprising a hollow body 11 shaped like a tapered cylinder having an outer diameter gradually reduced from the top toward the bottom (the direction from the top toward the bottom is subject to the direction shown in the drawings) and terminating in an expanded bottom opening 111, an annular lip 12 curved outwardly upwards from the bottom side of the hollow body 11 around the bottom opening 111, an upright barrel 13 vertically extended from the top side of the hollow body 11, a circular passage hole 131 in communication between the inside space of the hollow body 11 and the inside space of the upright barrel 13, a tubular flange 14 downwardly extended from the horizontal top of the upright barrel 13 and defining an axially extended center through hole 141, and a friction ring 15 adhered to the top side of the hollow body 11 and spaced around the upright barrel 13. The center through hole 141 has an oblong cross section with two straight sides arranged in parallel and two arched sides bilaterally connected between the straight sides (see FIG. 4). The friction ring 15 has an annular coupling groove 151 in the topmost edge thereof.

Referring to FIGS. from 5 through 7, the rotary member 20 is injection-molded from plastics, comprising a hollow cylindrical body 21 defining a bottom opening 211, a horizontal stop flange 22 outwardly extended from the bottom side of the hollow cylindrical body 21 around the bottom opening 211, three pairs of outside radial ribs 23 equiangularly spaced around the periphery of the hollow cylindrical body 21, each radial rib 23 having an arched top side curved upwardly inwards, a circular top recess 212 at the top side of the hollow cylindrical body 21, a circular center coupling hole 213 vertically extended through the center of the circular top recess 212, and an inside annular positioning flange 24 integral with a part of the inside wall of the hollow cylindrical body 21, and six radial reinforcing ribs 25 equiangularly spaced around the inside wall of the hollow cylindrical body 21 above the inside annular positioning flange 24. The diameter of the circular center coupling hole 213 fits the major axis of the oblong cross section of the center through hole 141 of the tubular flange 14 of the holder base 10.

Referring to FIG. 1 again, the hollow cylindrical body 21 of the rotary member 20 is sleeved onto the hollow body 11 of the holder base 10 with the circular center coupling hole 213 aimed at the center through hole 141 of the tubular flange 14 of the holder base 10 and the inside annular positioning flange 24 coupled to the annular coupling groove 151 of the friction ring 15, for enabling the rotary member 20 to be rotated on the holder base 10.

Referring to FIGS. from 8 through 10, the adjustment member 30 is injection-molded from plastics, comprising a cylindrical body 31, a hexagonal bottom hole 311 in the bottom side of the cylindrical body 31, a hexagonal bolt 32 fitted into the hexagonal bottom hole 311 (the hexagonal bottom hole 311 having thin ribs 312 longitudinally disposed in the six sides thereof for engagement with the periphery of the hexagonal bolt 32), the hexagonal bolt 32 having a center screw hole 321, a top center hole 313 vertically extended through the center of the cylindrical body 31 in vertical alignment with the center screw hole 321 of the hexagonal bolt 32, a side extension plate 33 downwardly extended from the periphery of the cylindrical body 31 at one side, an end plate 34 radially outwardly extended from the bottom side of the side extension plate 33 remote from the cylindrical body 31, an end notch 341 in the middle of the end plate 34, and a plurality of ribs 35 integral with the side extension plate 33 and the end plate 34.

Referring to FIGS. 1 and 2 again, the cylindrical body 31 of the adjustment member 30 is inserted through the circular passage hole 131 of the holder base 10 into the inside of the upright barrel 13, keeping the side extension plate 33 and ribs 35 of the adjustment member 30 suspended in the hollow body 11 of the holder base 10 at one side, the end plate 34 in flush with the bottom opening 111 of the hollow body 11 of the holder base 10.

Figure 11:
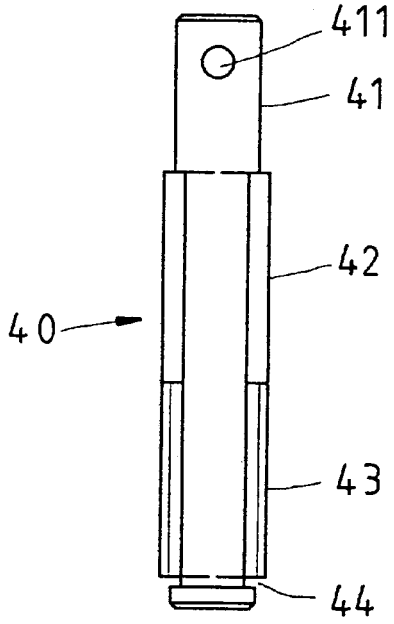
FIG. 11 is a sectional view of the rod member for the preferred embodiment of the present invention.
Figure 12:
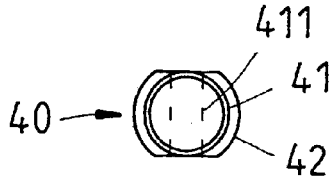
FIG. 12 is a top view of the rod member for the preferred embodiment of the present invention.

Referring to FIGS. 11 and 12, the rod member 40 is processed from a metal rod having a protruded front section 41, a threaded rear section 43, an intermediate insertion section 42 connected between the protruded front section 41 and the threaded rear section 43, a pin hole 411 transversely extended through the protruded front section 41, and an annular groove 44 around the periphery of the threaded rear section 43 near one end remote from the intermediate insertion section 42. The cross section of the intermediate insertion section 42 fits the center through hole 141 of the tubular flange 14 of the holder base 10. The cross section of the rear section 43 is same as the intermediate insertion section 42, however the rear section 43 has threads at the two smoothly curved opposite sides thereof. The protruded front section 41 is shaped like a round rod of diameter smaller than the intermediate insertion section 42, peripherally disposed in flush with two opposite parallel flat sides of the intermediate insertion section 42 (see FIG. 12).

Figure 13:
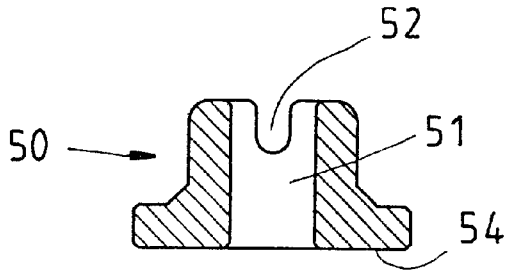
FIG. 13 is a sectional view of the pressure block for the preferred embodiment of the present invention.
Figure 14:
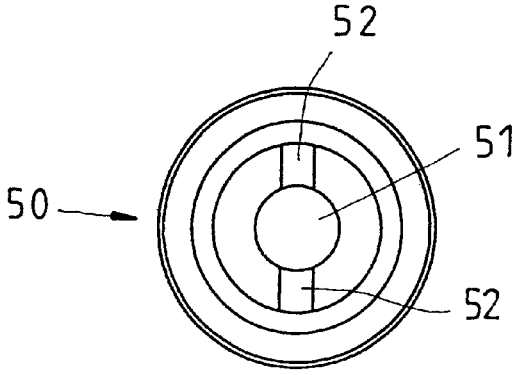
FIG. 14 is a top view of the pressure block for the preferred embodiment of the present invention.

Referring to FIGS. 13 and 14 and FIG. 1 again, the rod member 40 is inserted through the center through hole 141 of the tubular flange 14 of the holder base 10 into the circular center coupling hole 213 of the hollow cylindrical body 21 of the rotary member 20 with the threaded rear section 43 threaded into the screw hole 321 of the bolt 32 and the protruded front section 41 coupled to a pressure block 50 at the top of the rotary member 20. The pressure block 50 is a rounded plastic block having a flat bottom face 54 pressed on the top side of the rotary member 20, a center through hole 51 coupled to the protruded front section 41 of the rod member 40, and two top grooves 52 radially extended from the center through hole 51 to the periphery in reversed directions. A pin 53 is inserted through the pin hole 411 of the protruded front section 41 of the rod member 40 and positioned in the top grooves 52 to secure the rod member 40 to the pressure block 50. A C-shaped retainer ring 45 is fastened to the annular groove 44 of the rod member 40 at the bottom side of the bolt 32. As indicated, the pressure block 50 and the C-shaped retainer ring 45 are fastened to the rod member 40 and respectively stopped above the rotary member 30 and below the bolt 32, keeping the rotary member 20, the holder base 10 and the adjustment member 30 coupled together.

Referring to FIG. 1 again, the spring member 60 is mounted inside the hollow body 11 of the holder base 10 around the tubular flange 14 of the holder base 10 and the rod member 40, and stopped between the inside wall of the upright barrel 13 of the holder base 10 and the cylindrical body 31 of the rotary member 30 (according to the present preferred embodiment, two washers 61 and 62 are respectively fastened to the two ends of the spring member 60 and respectively stopped at the inside wall of the upright barrel 13 of the holder base 10 and the cylindrical body 31 of the rotary member 30). The spring member 60 stops the adjustment member 30 from rotation.

After the adjustable roll of plastic film dispensing apparatus has been assembled, the rotary member 20 can be rotated on the holder base 10, and the adjustment member 30 can also be rotated on the axis passing through the longitudinal center of the cylindrical body 31 relative to the holder base 10. Because the intermediate insertion section 42 of the rod member 40 is coupled to the center through hole 141 of the tubular flange 14 of the holder base 10, the rod member 40 can be moved axially relative to the holder base 10 but is prohibited from rotary motion relative to the holder base 10. Therefore, when rotating the rotary member 30, the rod member 40 and the rotary member 30 are moved axially relative to each other.

Referring to FIG. 1 again, when rotating the adjustment member 30 in one direction, the rod member 40 and the rotary member 30 are moved axially away from each other (the adjustment member 30 is moved downwards relative to the rod member 40 or, the rod member 40 is moved upwards relative to the adjustment member 30) to such an extent that the C-shaped retainer rind 45 is stopped at the bolt 32. When lowering the adjustment member 30 relative to the rod member 40, the distance between the pressure block 50 and the adjustment member 30 is relatively increased, thereby causing the pressure block 50 to be spaced away from the top side (the bottom of the circular top recess 212) of the rotary member 20. At this time, the spring member 60 is released, the pressure block 50 gives no pressure to the rotary member 20, and the inside annular positioning flange 24 of the rotary member 20 is disposed in contact with the friction ring 15 at the holder base 10 slightly, enabling the rotary member 20 to be rotated smoothly on the holder base 10.

On the contrary, when rotating the adjustment member 30 in the reversed direction, the adjustment member 30 and the rod member 40 are axially moved toward each other to pull the pressure block 50 downwards relative to the rotary member 20, thereby causing the flat bottom face 54 of the pressure block 50 to be pressed on the top side of the rotary member 20 and the spring member 60 to be compressed. When continuously rotating the adjustment member 30, the rod member 40 is forced downwards, causing the pressure block 50 to give a downward pressure to the rotary member 20, and therefore the friction resistance between the inside annular positioning flange 24 of the rotary member 20 and the friction ring 15 at the holder base 10 is gradually increased to stop the rotary member 20 from rotary motion relative to the holder base 10.

Figure 15:
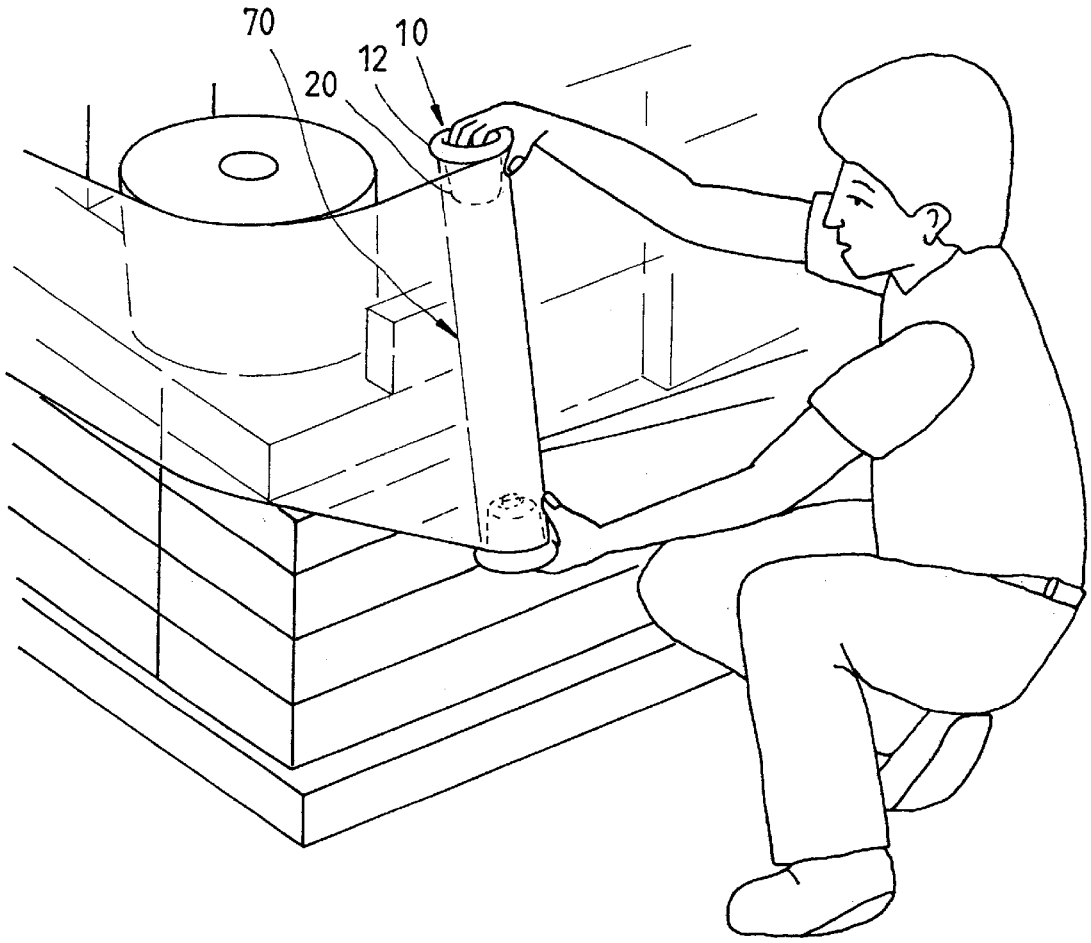
FIG. 15 shows an application example of the preferred embodiment of the present invention.

FIG. 15 shows an application example of the present invention. As illustrated, two adjustable roll of plastic film dispensing apparatus are respectively mounted in the two ends of a roll of plastic film 70 and operated with the hands to apply the roll of plastic film 70 to the object to be packed. By means of the guide of the tapered radial ribs 23 of the rotary member 20 of each adjustable roll of plastic film dispensing apparatus, the two adjustable roll of plastic film dispensing apparatus can easily be inserted into the two ends of the roll of plastic film 70. When installed, the horizontal stop flange 22 of the rotary member 20 of each adjustable roll of plastic film dispensing apparatus is respectively stopped outside the roll of plastic film 70, keeping the inner diameter of the roll of plastic film 70 in friction engagement with the rotary member 20 of each adjustable roll of plastic film dispensing apparatus for synchronous rotation. When applying the roll of plastic film 70, press the thumb of each hand on the annular lip 12 of the holder base 10 of each adjustable roll of plastic film dispensing apparatus respectively, keeping the other four fingers inserted into the inside of the hollow body 11 of the corresponding adjustable roll of plastic film dispensing apparatus and pressed on the inner side of the side extension plate 33 of the corresponding adjustment member 30. At this time, the user can rotate the adjustment member 30 relative to the holder base 10 with the four fingers directly, or insert the thumb into the end notch 341 of the end plate 34 and then rotate the rotary member 30 relative to the holder base 10 to adjust the tightness between the rotary member 20 and the holder base 10.

As indicated above, the rotating the adjustment member 30 changes the tightness between the rotary member 20 and the holder base 10. When applying the roll of plastic film to the object to the packed, the adjustment member 30 is rotated in one direction to loosen the connection between the rotary member 20 and the holder base 10, for enabling the rotary member 20 to be smoothly rotated with the roll of plastic film relative to the holder base 10. On the contrary, when pulling tight the plastic film, rotate the adjustment member 30 in the reversed direction to adjust the friction resistance between the rotary member 20 and the holder base 10, preventing the rotary member 20 from rotary motion relative to the holder base 10.

A preferred embodiment of the present invention has been constructed with the features of FIGS. 1~15. The plastic film dispensing apparatus functions smoothly to provide all of the features discussed earlier.

However, the invention is not limited to the description of the aforesaid preferred embodiment. Various modifications and enhancements may be made without departing from the spirit and scope of the invention. For example, the spring member 60 may be eliminated. In this case, the adjustment member is pivoted to the holder base and prohibited from axial movement relative to the holder base, and the rod member is fastened to the adjustment member by a screw joint for displacement in axial direction upon rotary motion of the adjustment member. The rod member can be made having a press portion disposed above the rotary member and adapted for pressing the rotary member to stop the rotary member from rotary motion relative to the holder base. In this case, the stop block 50 is eliminated. The holder base 10 can be made without the aforesaid friction ring 15. The rotary member and the holder base can be made having friction portions for engagement.

What is claimed is:

1. A roll of plastic film dispensing apparatus comprising:

a holder base, said holder base having a bottom opening and a top center through hole in two ends of a hollow body thereof;

a rotary member supported on said holder base, said rotary member comprising a hollow cylindrical body defining a bottom opening and sleeved onto the hollow body of said holder base, a top center coupling hole disposed in vertical alignment with the top center through hole of said holder base, and a positioning flange supported on said holder base;

an adjustment member pivoted to the hollow body of said holder base, said adjustment member comprising a screw hole disposed in axial alignment with the top center through hole of said holder base; and a rod member provided with a insertion section inserted through the top center through hole of said holder base and the top center coupling hole of said rotary member, a threaded section disposed at an end thereof and threaded into the screw hole of said adjustment member, and a press portion disposed at an opposite end thereof for axial movement with said rod member relative to said rotary member upon rotary motion of said adjustment member and being capable of contacting said rotary member.

2. The film dispensing apparatus as claimed in claim 1, further comprising a spring member stopped between said holder base and said adjustment member.

3. The film dispensing apparatus as claimed in claim 2, wherein said holder base further comprises an upright barrel vertically extended from a top side of the hollow body of said holder base in direction reversed to the bottom opening of said holder base and defining the top center through hole of said holder base; the hollow cylindrical body of said rotary member is covered on the hollow body and upright barrel of said holder base; said adjustment member comprises a cylindrical body inserted through the bottom opening of said holder base into the inside of the upright barrel of said holder base; said spring member is mounted inside the upright barrel of said holder base around said rod member.

4. The film dispensing apparatus as claimed in claim 1, wherein the top center coupling hole of said rotary member extends from the inside of the hollow cylindrical body of said rotary member to the outside; said rod member has a protruded front section axially extended from one end thereof reversed to said threaded bottom section and inserted through the top center coupling hole of said rotary member to the outside of said rotary member; said rod member further comprises a pressure block fixedly fastened to the protruded front section outside said rotary member, said pressure block having an inner face forming said press portion.

5. The film dispensing apparatus as claimed in claim 1, wherein the positioning flange of said rotary member is an annular flange extended around an inside wall of the hollow cylindrical body of said rotary member and stopped at the hollow body of said holder base.

6. The film dispensing apparatus as claimed in claim 5, wherein said holder base further comprises a friction ring protruded from the hollow body thereof and disposed in contact with the positioning flange of said rotary member.

7. The film dispensing apparatus as claimed in claim 1, wherein said adjustment member comprises a cylindrical body pivoted to the hollow body of said holder base, a side extension plate downwardly extended from the periphery of the cylindrical body of said adjustment member at one side, an end plate radially outwardly extended from a bottom side of said side extension plate remote from the cylindrical body of said adjustment member, and an end notch in said end plate; said screw hole is disposed at the center of the cylindrical body of said adjustment member.

8. The film dispensing apparatus as claimed in claim 1, wherein said adjustment member has a bolt embedded therein, said bolt defining said screw hole for the mounting of said rod member.

9. The film dispensing apparatus as claimed in claim 1, wherein said holder base comprises an annular lip curved outwardly upwards from a bottom side of the hollow body of said holder base around the bottom opening of said holder base; said rotary member comprises a horizontal stop flange outwardly extended from a bottom side of the hollow cylindrical body of said rotary member around the bottom opening of said rotary member, and a plurality of outside radial ribs equiangularly spaced around the periphery of the hollow cylindrical body of said rotary member.

* * * * *